US005896880A

United States Patent [19]

Bushweller et al.

[11] Patent Number: 5,896,880

[45] Date of Patent: Apr. 27, 1999

[54] BOOK UMBRELLA

[76] Inventors: Sarah H. Bushweller; Scott W. Bushweller, both of 200 La Bonne Vie Dr. #123D, East Patchogue, N.Y. 11772

[21] Appl. No.: 08/997,929

[22] Filed: Dec. 24, 1997

[51] Int. Cl.[6] ..... A47B 97/00

[52] U.S. Cl. ..... 135/16; 135/20.1; 362/98

[58] Field of Search ..... 135/16, 20.1; 248/104, 248/160, 231.5, 288.3; 362/98

[56] References Cited

U.S. PATENT DOCUMENTS

| | | | |
|---|---|---|---|
| 1,783,972 | 12/1930 | Moses | 135/15.1 |
| 1,996,071 | 4/1935 | Kahn | 135/20.1 |
| 2,128,634 | 8/1938 | Capaldo | 135/15.1 |
| 2,502,677 | 4/1950 | Sobotka | 135/33.6 X |
| 3,177,883 | 4/1965 | Militano | 135/15.1 |
| 3,304,035 | 2/1967 | Davis | 135/20.1 X |
| 3,454,022 | 7/1969 | Ferguson | 135/33.6 X |
| 3,893,467 | 7/1975 | Wingen | 135/25.1 |
| 4,581,684 | 4/1986 | Mazzucco | 362/98 |
| 4,598,340 | 7/1986 | Dwosh et al. | 362/98 |
| 4,799,858 | 1/1989 | Shin-Chin | 248/231.5 X |
| 4,998,551 | 3/1991 | DeSarno | 135/15.1 |
| 5,016,845 | 5/1991 | Pellegrino | 248/104 |
| 5,135,189 | 8/1992 | Ghazizadeh | 248/104 |
| 5,195,714 | 3/1993 | Stewart | 248/448 |

FOREIGN PATENT DOCUMENTS

| | | | |
|---|---|---|---|
| 443924 | 2/1950 | Italy | 135/16 |

*Primary Examiner*—Carl D. Friedman
*Assistant Examiner*—Laura A. Callo

[57] ABSTRACT

A miniature umbrella is provided for use with a piece of reading material. Further provided is a protective cover for protecting the reading material from sunlight. Also included is clip for coupling the protective cover to the piece of reading material.

1 Claim, 2 Drawing Sheets

BOOK UMBRELLA

BACKGROUND OF THE INVENTION

1. Field of the Invention

The present invention relates to umbrellas and more particularly pertains to a new book umbrella for allowing a user to read a book in the presence of bright light.

2. Description of the Prior Art

The use of umbrellas is known in the prior art. More specifically, umbrellas heretofore devised and utilized are known to consist basically of familiar, expected and obvious structural configurations, notwithstanding the myriad of designs encompassed by the crowded prior art which have been developed for the fulfillment of countless objectives and requirements.

Known prior art umbrellas include U. S. Pat. No. 5,396,915; U.S. Pat. No. 5,394,822; U.S. Pat. No. 5,433,233; U.S. Pat. No. 5,277,211; U.S. Des. Pat. No. 329,761; and U.S. Des. Pat. No. 361,654.

In these respects, the book umbrella according to the present invention substantially departs from the conventional concepts and designs of the prior art, and in so doing provides an apparatus primarily developed for the purpose of allowing a user to read a book in bright sunlight.

SUMMARY OF THE INVENTION

In view of the foregoing disadvantages inherent in the known types of umbrellas now present in the prior art, the present invention provides a new book umbrella construction wherein the same can be utilized for allowing a user to read a book in bright sunlight.

The general purpose of the present invention, which will be described subsequently in greater detail, is to provide a new book umbrella apparatus and method which has many of the advantages of the umbrellas mentioned heretofore and many novel features that result in a new book umbrella which is not anticipated, rendered obvious, suggested, or even implied by any of the prior art umbrellas, either alone or in any combination thereof.

To attain this, the present invention generally comprises a post having a rigid upper extent having a cylindrical configuration with a bulbous top end. As shown in FIG. 4, a triangular protrusion is formed at a central extent thereof and extended radially outward therefrom. A flexible deformable lower extent is provided with a constant circular cross-sectional along an entire length thereof. The deformable lower extent has a top end integrally coupled to a bottom end of the upper extent. It should be noted that a length of the lower extent of the post is larger than that of the upper extent. Next provided is a frame support assembly including a cylindrical sleeve, as shown in FIG. 4. Such sleeve is slidably situated about the upper extent of the post between the top end and the protrusion thereof. A plurality of rigid linear supports are pivotally coupled at inboard ends thereof to an outer surface of the sleeve about a circumference thereof. Also included is a cover with a flexible portion having a generally circular configuration. Formed in a central extent of the cover is an aperture which is situated about a top end of the upper extent of the post. The cover further has a plurality of resilient rods each pivotally coupled to the top end of the upper extent of the post and extended radially therefrom. Each resilient rod is equipped with a length about twice that of the supports of the frame support assembly. As shown in both FIGS. 3 & 4, a midpoint of each resilient rod is pivotally coupled to an outboard end of an associated one of the supports of the frame support assembly. By this structure, the flexible portion of the cover is adapted be transferred between a deployed orientation wherein the cover defines a portion of a sphere and a stored orientation wherein the cover defines a cone. Finally, a clip includes a pair of planar generally rectangular strips each having a gripping end with a beveled lip integrally coupled thereon and a clamping end. The clip further includes a spring coupled between the strips of the clip for urging the clamping ends thereof in engagement. As shown in FIGS. 1 & 2, a top surface of one of the strips is integrally coupled at a central extent thereof in perpendicular relationship with a bottom end of the lower extent of the post.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new book umbrella apparatus and method which has many of the advantages of the umbrellas mentioned heretofore and many novel features that result in a new book umbrella which is not anticipated, rendered obvious, suggested, or even implied by any of the prior art umbrellas, either alone or in any combination thereof.

It is another object of the present invention to provide a new book umbrella which may be easily and efficiently manufactured and marketed.

It is a further object of the present invention to provide a new book umbrella which is of a durable and reliable construction.

An even further object of the present invention is to provide a new book umbrella which is susceptible of a low cost of manufacture with regard to both materials and labor, and which accordingly is then susceptible of low prices of sale to the consuming public, thereby making such book umbrella economically available to the buying public.

Still yet another object of the present invention is to provide a new book umbrella which provides in the apparatuses and methods of the prior art some of the advantages thereof, while simultaneously overcoming some of the disadvantages normally associated therewith.

Still another object of the present invention is to provide a new book umbrella for allowing a user to read a book in bright sunlight.

Even still another object of the present invention is to provide a new book umbrella for use with a piece of reading material. Further provided is a protective cover for protecting the reading material from sunlight. Also included is clip for coupling the protective cover to the piece of reading material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
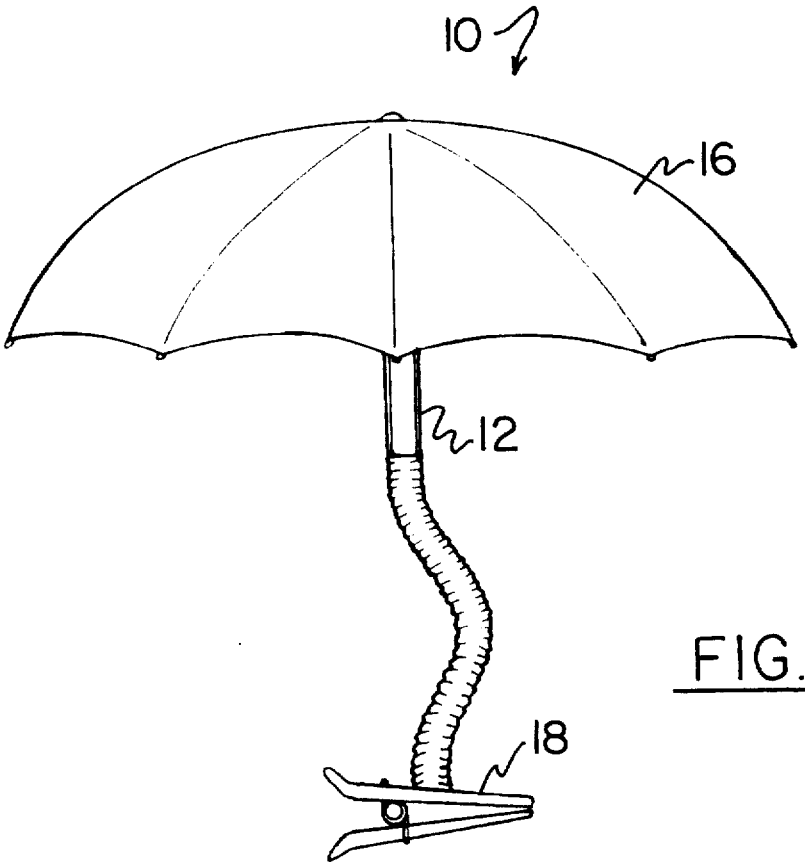
FIG. 1 is a side view of a new book umbrella according to the present invention.

With reference now to the drawings, and in particular to FIGS. 1 through 4 thereof, a new book umbrella embodying the principles and concepts of the present invention and generally designated by the reference numeral 10 will be described.

Figure 4:
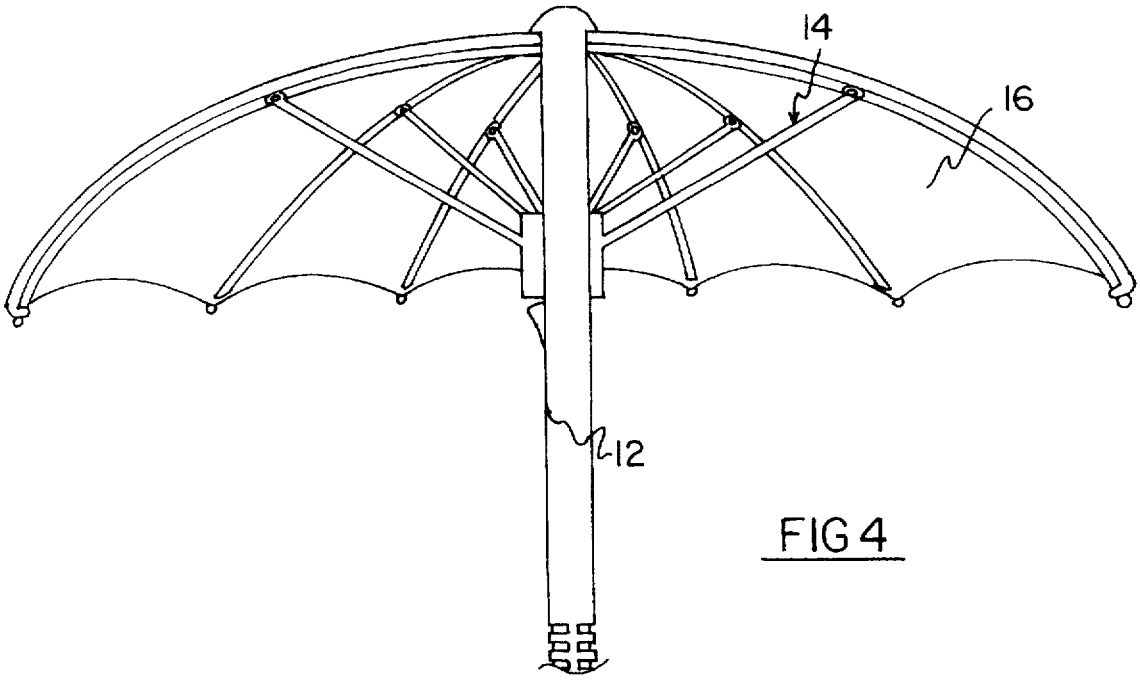
FIG. 4 is a cross-sectional view of the present invention.

The present invention, designated as numeral 10, comprises a post 12 having a rigid upper extent with a cylindrical configuration and a bulbous top end. As shown in FIG. 4, a triangular protrusion is formed at a central extent of the upper extent and extended radially outward therefrom. A flexible deformable lower extent is provided with a constant circular cross-sectional along an entire length thereof. The deformable lower extent has a top end integrally coupled to a bottom end of the upper extent. It should be noted that a length of the lower extent of the post is larger than that of the upper extent.

Next provided is a frame support assembly 14 including a cylindrical sleeve, as shown in FIG. 4. Such sleeve is slidably situated about the upper extent of the post between the top end and the protrusion thereof. A plurality of rigid linear supports are pivotally coupled at inboard ends thereof to an outer surface of the sleeve about its circumference.

Also included is a cover 16 with a nylon flexible portion having a generally circular configuration with a diameter of preferably less than 1 foot. Formed in a central extent of the cover is an aperture which is situated about the top end of the upper extent of the post. The cover further has a plurality of resilient rods each pivotally coupled to the top end of the upper extent of the post and extended radially therefrom. Each resilient rod is equipped with a length about twice that of the supports of the frame support assembly. As shown in both FIGS. 3 & 4, a midpoint of each resilient rod is pivotally coupled to an outboard end of an associated one of the supports of the frame support assembly. By this structure, the flexible portion of the cover is adapted be transferred between a deployed orientation wherein the cover defines a portion of a sphere and a stored orientation wherein the cover defines a cone.

Figure 2:
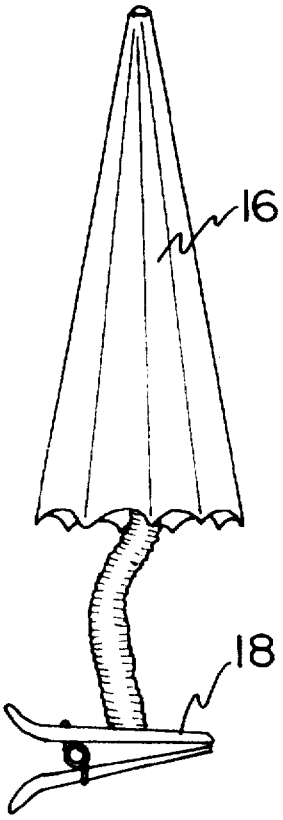
FIG. 2 is a side view of the present invention in a stored orientation.
Figure 3:
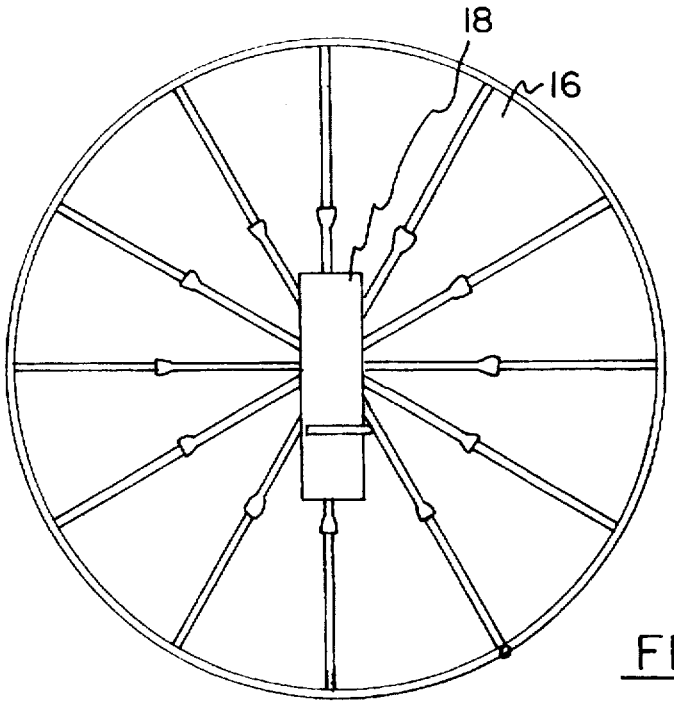
FIG. 3 is a bottom view of the present invention.

Finally, a clip 18 includes a pair of planar generally rectangular strips each having a gripping end with a beveled lip integrally coupled thereon and a clamping end. The clip further includes a spring coupled between the strips of the clip for urging the clamping ends thereof in engagement. As shown in FIGS. 1 & 2, a top surface of one of the strips is integrally coupled at a central extent thereof in perpendicular relationship with a bottom end of the lower extent of the post.

During use, the clip is clamped to a book or other type of reading material. Next, the cover is transferred to its deployed orientation. The deformable extent of the post is then bent such that the cover protects the reading material from any bright ambient light in order to facilitate reading.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A miniature umbrella covering system comprising, in combination:

a book;

a post having a rigid upper extent having a cylindrical configuration with a bulbous top end and a triangular protrusion formed at a central extent thereof and extending radially outward therefrom and a flexible deformable lower extent with a constant circular cross-sectional along an entire length thereof and having a top end integrally coupled to a bottom end of the upper extent, wherein a length of the lower extent of the post is larger than that of the upper extent;

a frame support assembly including a cylindrical sleeve slidably situated about the upper extent of the post between the top end and the protrusion thereof, a plurality of rigid linear supports pivotally coupled at inboard ends thereof to an outer surface of the sleeve about a circumference thereof;

a nylon cover with a diameter of less than a foot including a flexible portion having a generally circular configuration and an aperture formed in a central extent thereof situated about a top end of the upper extent of the post, the cover further having a plurality of resilient rods each pivotally coupled to the top end of the upper extent of the post and extending radially therefrom with a length about twice that of the supports of the frame support assembly, wherein a midpoint of each resilient rod is pivotally coupled to an outboard end of an associated one of the supports of the frame support assembly, whereby the flexible portion of the cover is adapted be transferred between a deployed orientation wherein the cover defines a portion of a sphere and a stored orientation wherein the cover defines a cone; and a clip coupled to the post including pair of planar generally rectangular strips each having a gripping end with an outwardly extending beveled lip integrally coupled thereon and a clamping end removably coupled to the book, the clip further including a spring coupled between the strips of the clip for urging the clamping ends thereof in engagement, wherein one of the strips of the clip is mounted at a central extent thereof to a bottom of the lower extent of the post.

* * * * *